US005791542A

United States Patent [19]

Porat et al.

[11] Patent Number: 5,791,542

[45] Date of Patent: Aug. 11, 1998

[54] YARN TEST SYSTEM WHICH MOVES YARN AT HIGH SPEED UNDER CONSTANT, ADJUSTABLE TENSION

[75] Inventors: Itzchak Porat, Goostrey, England; Kendall W. Gordon, Jr., North Kingston; Avishai Nevel, Providence, both of R.I.; David Bonneau, West Boylston, Mass.

[73] Assignee: Lawson-Hemphill, Inc., Pawtucket, R.I.

[21] Appl. No.: 825,263

[22] Filed: Mar. 27, 1997

Related U.S. Application Data

[63] Continuation of Ser. No. 683,700, Jul. 17, 1996, abandoned.

[51] Int. Cl.[6] ..... B23Q 15/00

[52] U.S. Cl. ..... 226/44; 226/118.2

[58] Field of Search ..... 226/42, 44, 45, 226/114, 118, 111, 113, 118.2; 242/413.5, 413.6, 418.1, 47.08, 49

[56] References Cited

U.S. PATENT DOCUMENTS

| | | | |
|---|---|---|---|
| 4,966,333 | 10/1990 | Bosch | 242/413.5 X |
| 5,402,956 | 4/1995 | Lemke | 226/44 X |
| 5,472,127 | 12/1995 | Ichii et al. | 226/44 |

*Primary Examiner*—Donald P. Walsh
*Assistant Examiner*—William A. Rivera
*Attorney, Agent, or Firm*—Brian M. Dingman

[57] ABSTRACT

A system for moving yarn under substantially constant tension, including a translationally-fixed pivoting device, having a neutral position, for applying tension to the yarn, and a variable-speed yarn drive for moving the yarn across the pivoting device. The rotational position of the pivoting device is determined in relation to its neutral position, and in response, the speed of the yarn drive is altered to move the pivoting device closer to its neutral position for maintaining a relatively constant tension on the yarn.

16 Claims, 2 Drawing Sheets

YARN TEST SYSTEM WHICH MOVES YARN AT HIGH SPEED UNDER CONSTANT, ADJUSTABLE TENSION

CROSS REFERENCE TO RELATED APPLICATION

This application is a continuation of Ser. No. 08/683,700, filed on Jul. 17, 1996, now abandoned.

FIELD OF INVENTION

This invention relates to a yarn test system which allows the application of a controlled, constant tension to the yarn while moving at high speed to allow the operator to test the effect of tension on the yarn.

BACKGROUND OF INVENTION

In the testing of yarns it is important to be able to test the effect of the application of a known tension on the yarn while the yarn is moving at a known velocity. This allows the test operator to mimic the effect of production equipment on the yarn, which helps to create a better end product.

One attempt at solving this problem is the FYL-500S Toray Yarn Dye Affinity Testing System, Toray Engineering Co. Ltd., #2, Mitsui Building, 4-18, 3-Chome, Nakanoshima Kita-Ku, Osaka, Japan. That device has two yarn drive mechanisms, and a means for intermittently measuring the yarn tension in the measurement zone between the yarn drives, and in response adjusting the yarn speed to maintain a constant tension. This system, however, requires that the yarn be touched with the tension-measuring device in the measurement zone. Since any touching of the yarn has an effect on the yarn, this tension measurement causes unknown errors in the measurement system.

Another solution is described in U.S. Pat. No. 4,393,701, issued on Jul. 19, 1983. That system is a mechanical system which responds to a change in length of the yarn between fixed roll pairs which drive the yarn into and out of a measurement zone, and in response adjusts the speed of the rolls that pull the yarn out of the measurement zone to maintain the tension arm in its original (typically either vertical or horizontal) position. This system requires a complex variable speed mechanical yarn drive which has a number of moving parts including drive belts which slip and wear, and add inertia to the test system. In addition, the yarn path length in the measurement zone between roll pairs changes depending on the yarn shrinkage or stretch in the measurement zone as a result of the movement of the carriage which carries the tension arm. This introduces another unknown into the measurement system, resulting in measurement error.

SUMMARY OF INVENTION

It is therefore an object of this invention to provide a system for moving yarn under substantially constant tension which has less error than other such systems.

It is a further object of this invention to provide such a system which has fewer moving parts than other such systems.

It is a further object of this invention to provide such a system which uses separate, direct yarn driving mechanisms.

It is a further object of this invention to provide such a system which does not require tension measurement downstream of the point of tension application.

This invention features a system for moving yarn under substantially constant tension or heat, comprising: a translationally-fixed pivoting device, having a neutral position, for applying tension to the yarn; two separate variable-speed yarn drives for moving the yarn towards and across the pivoting device; means for determining the rotational position of the pivoting device in relation to its neutral position; and means, responsive to the means for determining the rotational position of the pivoting device, for altering the speed of at least one yarn drive to move the pivoting device closer to its neutral position for maintaining a relatively constant tension on the yarn. Each yam drive may include a variable-speed motor driven yarn drive mechanism. The means for altering the speed of the yarn drive may then include means for changing the speed of the motor driving the upstream and/or downstream yarn drive mechanism.

The means for altering the speed of a yarn drive may include means for changing the speed of the yarn drive in relation to the magnitude of the rotational deviation of the pivoting device from its neutral position, which may be accomplished with a proportional integral differential control system. The pivoting device may be a cantilever with a yarn-contacting structure towards one end. The cantilever neutral position may be vertical, and the pivot may be at the bottom end of the cantilever. The system may further include a spring coupled to the cantilever for applying tension to the yarn through the yarn-contacting structure, and means for adjusting the spring tension to alter the tension applied to the yarn. The means for determining the rotational position of the pivoting device may include a rotary encoder device, or a Hall-effect sensor, for sensing the pivot position.

The system may further include means for determining the speed of both yarn drive mechanisms, in which case the system may further include means for determining a change in yarn length, caused by the applied tension or heat, based on the speed of the two yarn drive mechanisms.

In a more specific embodiment this invention features a system for moving yarn under substantially constant tension, comprising: a translationally-fixed pivoting cantilever with a yarn-contacting structure at its end, the cantilever having a neutral position; a first yarn drive mechanism, driven by a first variable-speed motor, for moving yarn to the yarn-contacting structure; a variable-tension spring coupled to the cantilever for applying a known tension to the yarn in the yarn-contacting structure when the cantilever is in its neutral position; a rotary encoder at the cantilever pivot for determining the cantilever rotational position in relation to its neutral position; a second yarn drive mechanism, driven by a second variable-speed motor, for pulling the yarn across the yarn-contacting structure; and a yarn speed control system, responsive to the cantilever rotational position determined by the rotary encoder, for changing the speed of at least one variable-speed motor in relation to the magnitude of the rotational deviation of the cantilever from its neutral position, to move the cantilever closer to its neutral position for maintaining a relatively constant tension on the yarn.

This invention also features a system for moving yarn under substantially constant tension, comprising: first yarn drive means for moving the yarn into a measurement zone, having a known nominal yarn path length; second, separate yarn drive means for pulling the yarn out of the measurement zone; means for determining a change in the yarn path length in the measurement zone between the first and second yarn drive means; and means, responsive to the means for determining a change in the yarn path length, for adjusting at least one yarn drive means to change the yarn flow rate through the measurement zone for moving the yarn path length closer to the known nominal path length.

The means for determining a change in the yarn path length may include means for creating a yarn reservoir portion between the first and second yarn drives. In that case, the means for determining a change in the yarn path length may further include means for resolving a change in yarn length in the reservoir portion. The reservoir portion may be accomplished by passing the yarn over a translationally-fixed compliant member, which may be a pivoting device.

BRIEF DESCRIPTION OF THE DRAWINGS

Other objects, features and advantages will occur to those skilled in the art from the following description of a preferred embodiment and the accompanying drawings in which.

DESCRIPTION OF THE PREFERRED EMBODIMENT

Figure 1:
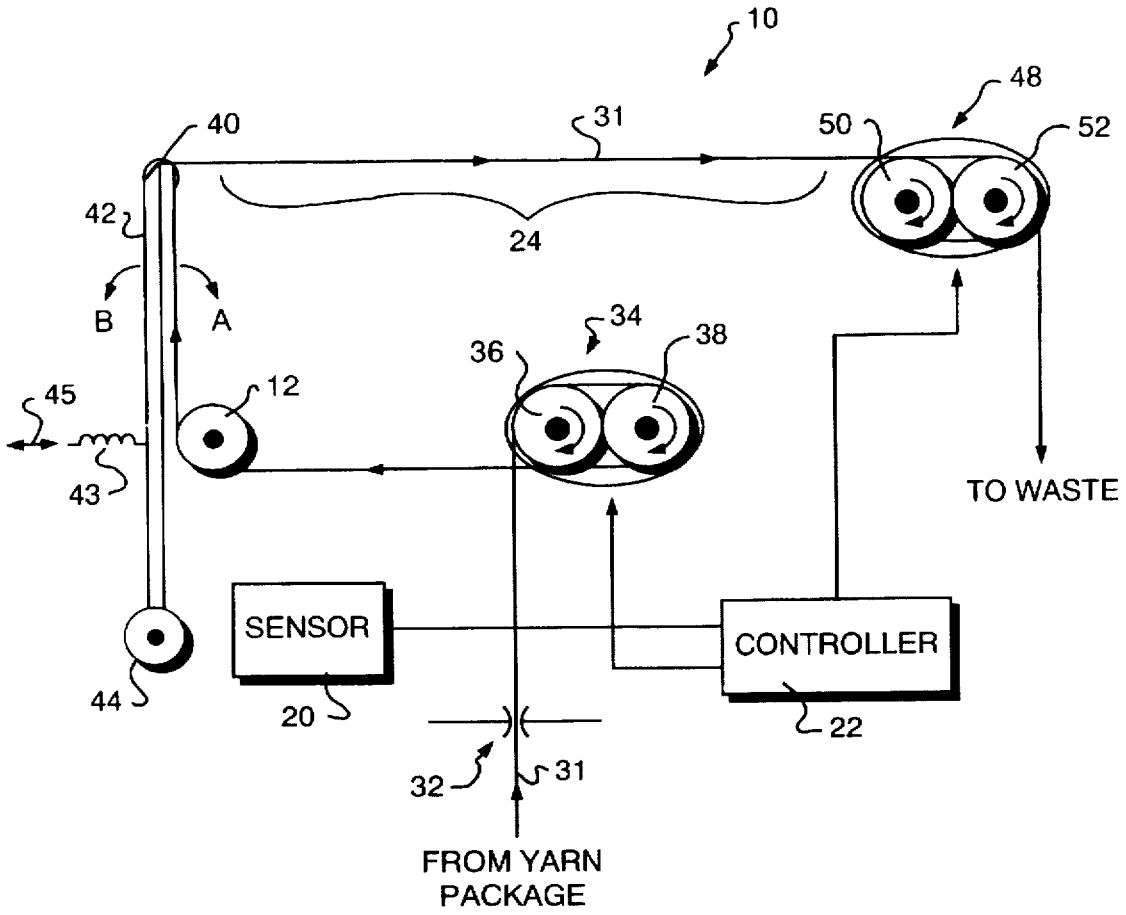
FIG. 1 is a schematic diagram of a system for moving yarn under substantially constant tension according to this invention.

This invention may be accomplished in a system for moving yarn under substantially constant tension, in which a translationally-fixed compliant member, such as a pivoting device or a flexible device, is used to apply tension to a moving yarn. Two separate variable-speed yarn drives are employed for moving yarn toward and across the compliant member. When the system is in equilibrium, the compliant member is in a neutral position. When the amount of stretch induced in the yarn by the tension application changes, the compliant member moves away from its neutral position. The system of this invention includes means for sensing the change in position of the compliant member in relation to its neutral position to determine this change in yarn path length in a measurement zone between the compliant member and the downstream yarn drive. In response to the change in position, the system alters the speed of one or both of the yarn drives to move the compliant member back closer to its neutral position. This correction quickly returns the system to equilibrium, in which the compliant member is in its neutral position, and thus the amount of tension applied to the yarn is known.

The system is preferably accomplished with two separate yarn drives—one upstream of the tension application device, and one downstream of the tension application device. This creates a zone between the yarn drives, in which the only contact with the yarn is the compliant member which applies the tension to the yarn. Accordingly, no structure touches the yarn between the point of tension application and the downstream yarn drive. The conditions on the yarn (speed and tension) are thus well established in the measurement zone. The relative speeds of the two drives while the compliant member is in its neutral position is then an indication of the amount that the yarn is being stretched by the application of tension or shrunk by the application of heat to the yarn in the measurement zone.

If the amount of yarn stretch decreases, the yarn flow rate downstream of the point of tension application will decrease. Since the downstream yarn drive speed at this point in time is constant, the yarn path length in the measurement zone must accordingly decrease, causing the compliant member to move in one direction. Thus, by measuring a change in position of the complaint member, a measure of a change in the yarn path length is accomplished. The system then adjusts the speed of the downstream and/or upstream yarn drive to alter the yarn flow rate through the measurement zone to move the yarn path length closer to the known, nominal, original, path length which exists when the compliant member is in its neutral position.

In the example in which the yarn stretch decreases, the yarn flow rate through the measurement zone would decrease, and the system would slow the speed of the downstream yarn drive until it was taking up the yarn exactly at the flow rate at which the yarn was provided to it. Conversely, if the amount of yarn stretch increases, the yarn path length in the measurement zone will increase, causing the compliant member to move in the other direction. The movement of the compliant member in the opposite direction is sensed, and in response the system increases the speed of the downstream yarn drive to match that speed with the increased yarn flow rate caused by the increased stretch. This correction is accomplished until the compliant member returns to its neutral position. At this point, the yarn path length in the measurement zone is fully defined, and the amount of tension applied to the yarn is known; the system is in equilibrium, with no error introduced either by the tension application device or by a change in the yarn path length in the measurement zone. All of this is accomplished without the need for tension measurement in the measurement zone between the point of application of the tension and the downstream yarn drive, which removes this source of error present in other devices.

There is shown in FIG. 1 a simplified schematic of system 10 according to this invention. System 10 is adapted to move yarn 31 under substantially constant tension at substantially constant velocity to allow the operator to determine the effect of tension on the yarn. Yarn 31 is pulled off of a package through pre-tensioner 32 by first yarn drive 34, which consists of two rollers driven in unison in the direction of the arrows. Yarn 31 contacts a U-shaped yarn contact portion 40 at the end of translationally-fixed pivoting cantilever 42 which is free to pivot about point 44. Device 42 is shown in its normal or neutral, vertical position. Sensor 20 determines the rotational position of pivoting device 42 in relation to its neutral position. The sensor signal is provided to controller 22 which, in response, alters the speed of upstream yarn drive 34, and/or downstream yarn drive 48, to move pivoting device 42 closer to its neutral position for maintaining a relatively constant tension on the yarn in the measurement zone between point 40 and downstream yarn drive 48.

Tension is applied to yarn 31 through arm 42, preferably with an adjustable tension spring 43. An adjustable-tension spring has been found to be the best means of tension application as there is virtually no drift in tension as there would be with other types of tension or force application devices, such as strain gauges which must be periodically calibrated.

When system 10 is in equilibrium, arm 42 is in the neutral position shown. The path length of the yarn in the measurement zone 24 between arm 42 and yarn drive 48 is fully defined. Further, nothing is touching the yarn in zone 24 between the point of application of tension at the top of arm 42 and yarn drive 48.

If, during operation of the system, the amount of yarn stretch caused by the application of tension at the top of arm 42 decreases, the flow rate of yarn in zone 24 will decrease, causing the path length in zone 24 to decrease, causing arm 42 to pivot in the direction of arrow A. The pivoting arm in effect creates a yarn reservoir which allows path length to decrease without breaking the yarn. This change in the pivot position of arm 42 is sensed by sensor 20, preferably using a rotary encoder which outputs a signal related to the amount of deviation from the vertical, neutral position of arm 42. Controller 22 in response to the signal from the rotary encoder commands drive 48 to slow. The control algorithm is described in more detail below in conjunction with FIG. 3. This slowing of yarn drive 48 decreases the rate at which yarn is pulled out of zone 24, which increases the yarn path length in zone 24, causing the arm to pivot back, in the direction of arrow B, towards its neutral position. The correction continues until arm 42 returns to its neutral position, at which time the system is again in equilibrium, with the yarn path length fully defined and the tension applied to the yarn fully defined. At equilibrium, the signal from sensor 20 causes no change in the speed of either yarn drive.

Conversely, if the amount of yarn stretch increases while the system is in equilibrium, the flow rate of yarn in zone 24 will increase, thus causing the path length in zone 24 as a result to increase. This causes arm 42 to pivot in the direction of arrow B. This change in rotational position of arm 42 is sensed, and the speed of drive 48 is increased to increase the flow rate of yarn through zone 24, which moves arm 42 back in the direction of arrow A towards its neutral position. This correction continues until arm 42 is in its neutral position.

In a preferred embodiment of the mechanical portion of the system of this invention, system 10 includes yarn pre-tension device 32 and a first yarn drive 34 which consists of rolls 36 and 38 which are driven in unison by a single variable-speed motor, not shown. The yarn is wrapped around rolls 36 and 38 a number of times and then routed over yarn contacting saddle 40 carried at the end of pivoting arm 42, which pivots about point 44. Tension is applied to the yarn at the point where it runs over saddle 40 by use of an adjustable tension spring 43 which is connected at one end to arm 42; the spring length may be changed in the direction of arrow 45 to change the tension applied to the yarn. Yarn 31 is then routed to exit yarn drive 48, which also consists of a pair of mutually-driven rolls 50 and 52 driven by a second variable speed motor. The yarn may be run through a tensiometer, not shown, between drives 34 and 48 if it is desirable to measure the actual tension on the yarn in the measurement zone. It should be understood that this is simply one embodiment, as yarn 31 may bypass the tensiometer and be routed directly from saddle 40 to yarn drive 48. The dual yarn drives and tension-application arm are described in more detail in U.S. Pat. No. 5,319,578 and in U.S. Pat. No. 4,393,701, issued Jul. 19, 1983, both incorporated herein by reference.

Figure 2:
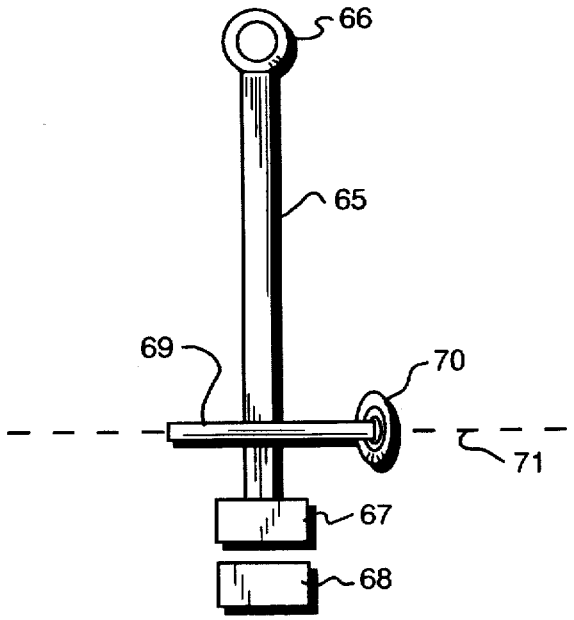
FIG. 2 is a schematic diagram of an alternative means of applying tension to the yarn and creating a yarn reservoir for the system of FIG. 1.

An alternative embodiment of the compliant member of FIG. 1 is shown in FIG. 2. Rigid arm 65 is attached to rotatable shaft 69 which rotates around axis 71. The yarn is threaded through loop 66 at the end of arm 65. The other end carries magnet 67. Watch spring 70 is coupled to shaft 69 to apply an urging force to arm 65 which provides the desired tension to the yarn running through structure 66. In the view shown, arm 65 would pivot into and out of the plane of the page. The position of arm 65 in relation to its neutral position, at which the tension applied to the yarn is known, is sensed by Hall-effect sensor 68 in conjunction with magnet 67.

In the embodiments shown, the device which applies the tension to the yarn is the same as the structure which provides a yarn reservoir portion, and also allows the change in yarn path length, or flow rate, to be sensed. However, this is not a necessary limitation of the invention, as the tension may be applied to the yarn at one point, and the yarn path length measured at another point. It is necessary to provide some means of accomplishing a yarn reservoir in the measurement zone so that changes in yarn length can be accommodated without breaking the yarn. The yarn path length or velocity change measurements are then made in the measurement zone (preferably in the reservoir area) as a means of providing a feedback signal to the controller which separately controls the speed of the two yarn drives to return the yarn path length to its nominal value.

Figure 3:
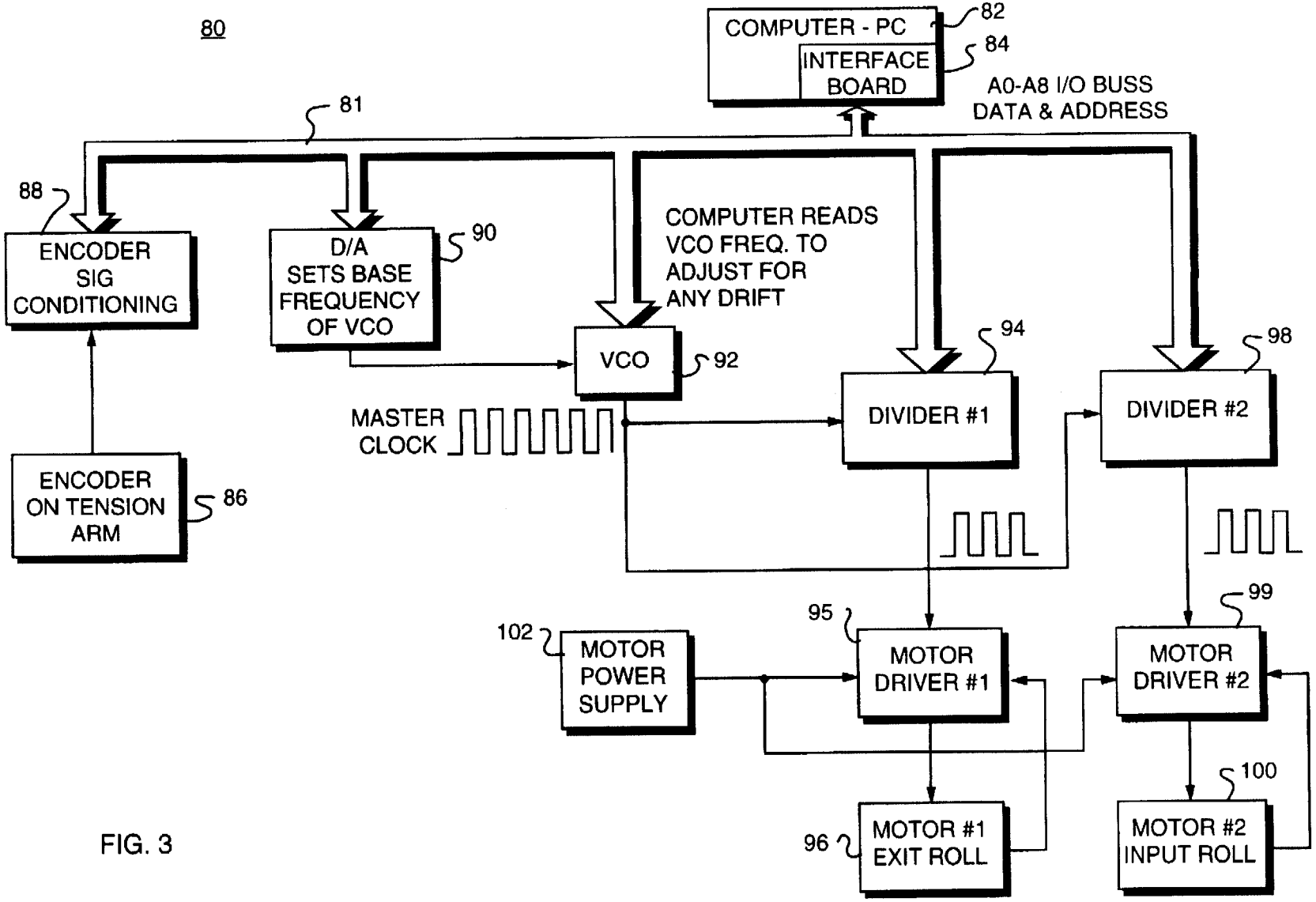
FIG. 3 is a schematic block diagram of the electronics portion of the preferred embodiment of the system of FIG. 1.

A block diagram of electronics 80 for the preferred embodiment of the system of this invention is shown in FIG. 3. System 80 includes a rotary encoder 86 which is attached to a translationally-fixed pivoting device such as the ones shown in FIGS. 1 and 2B. Encoder 86 provides electrical signals as the arm deviates from its neutral position. The arm neutral position is preferably indicated by a different, unique signal. These signals are conditioned by conditioner 88 so that they may be provided to computer 82 over I/O bus 81 through computer interface board 84.

System 80 also includes two sets of variable-speed motors and motor drivers—motor 96 drives the exit roll pair 48, and input motor 100 drives roll pair 34, FIG. 1. The motors are controlled by pulses supplied by the control system. The rate of the pulses determines the speed of the motor, and the number of pulses determines the number of revolutions the motor shaft turns.

The motor speed control is accomplished using a voltage controlled oscillator (VCO) 92 which acts as a pulse source for both of the motors. The VCO frequency is continuously monitored by computer 82 and adjusted by the computer to maintain a desired stability. This is accomplished using D/A converter 90 which provides an analog signal to VCO 92 which results in a desired master clock frequency provided to dividers 94 and 98. Preferably, D/A converter 90 is a 12-bit device which allows the computer to select any one of 4,096 individual output frequencies for VCO 92. Each individual frequency equates to a unique speed for each motor. A typical operating frequency for VCO 92 is 25 MHz.

The actual speed of the motors is controlled using dividers 94 and 98, which also each have a resolution of 12 bits. Accordingly, the combination of the VCO and the dividers can control motor speeds to a resolution of 24 bits. Each divider has the VCO output signal as its input. The output frequency of each divider is the frequency of the VCO divided by the divisor number, which is supplied separately to each divider by computer 82. The divisor is determined by the desired speed of the fixed speed input roll pair 34, and the signal generated by the tension arm encoder 86. Each divider may be different to cause the roll pairs to run at different speeds.

As an example, motors 96 and 100 may be configured such that 1,000 pulses will cause a single revolution of the motor. If the input roll pair is desired to operate at 3,000 rpm, a frequency of 3,000 divided by 60 times 1,000, or 50,000 pulses per second, is required at the output of divider 98. This is preferably accomplished by setting VCO 92 to run at 25 MHz. Divider 98 would then divide the signal by 500 to output 50,000 pulses per second, resulting in a motor speed of 3,000 rpm.

If the yarn elongation caused by the tension applied by the pivot arm is 2%, exit roll pair 48 must be driven by motor 96 at a speed 2% faster than the input roll pair to maintain the system in equilibrium. For the same VCO output, this would require that divider 94 be set at 2% less than 500, or 490. As long as the yarn elongation stays precisely at 2%, the computer will continue to maintain the divisors necessary for the 2% speed difference.

If the yarn length changes, the system must make a correction in the speed of one or both of the motors to return the yarn path length back to its nominal value. This is accomplished by a control algorithm programmed into computer 82. The algorithm is a proportional integral differential control technique in which the speed correction is equal to a first gain times the error signal from encoder 86, plus a second gain times some integral of the error signal. This technique allows the speed to be controlled so that the arm quickly returns to the neutral position. Preferably, the gains are set using a predefined look up table in computer 82 so that the proper gains can be provided for the desired motor speeds.

Since tension is being applied to the yarn at the end of the compliant member, there will always be an urging force pulling against the yarn. The system is in equilibrium when the tension applied to the yarn in the opposite direction by the output roll pair is equal to this input tension when the compliant member is in its neutral position. The position of the complaint member is thus related to the spring tension applied at the end of the member plus the yarn tension.

The control algorithm preferably operates on the basis of a base yarn drive speed, and the yarn draw ratio, which is equal to the speed of the output roll pair divided by the speed of the input roll pair. Assuming that the velocity of the input roll pair remains steady, the velocity of the output roll pair is then equal to the base speed (the input roll pair speed) plus the draw ratio, plus a number equal to the desired spring tension plus the deviation from the desired tension times a gain. An integral component is added to the proportional component of the control algorithm so that the compliant member error may reach zero.

The drive signals for the two motors are indicative of the flow rate of yarn into and out of the measurement zone, and thus may be used as a measure of elongation of the yarn caused by the application of tension at the saddle carried by the compliant member. If heat is also applied, shrinkage may occur and be measured. This measurement will be free of any error caused by an unknown yarn path length in the measurement zone, an unknown mass of yarn in the measurement zone, or any device touching the yarn in the measurement zone.

With this system in which the two yarn drives are separately controlled and maintain very accurately, it is possible to accomplish a number of different tests on yarn. The system allows both dynamic and static tests to be run on a single yarn sample. In the example discussed above, yarn elongation or shrinkage may be determined based on the application of a known tension at a known yarn velocity. There may need to be a provision for heating the yarn in the measurement zone to cause shrinkage if that is the desired property to be measured.

Alternatively, the system may be used as a dynamic drawing force tester as follows. The compliant member may be replaced with a fixed roller over which the yarn moves. The tension on the yarn in the measurement zone would then be measured by adding a tensiometer in measurement zone 24, FIG. 1. Input roll pair 34 would then be operated at a constant velocity. The velocity of output roll pair 48 would be cycled periodically between two values to cause a corresponding change in the amount that the yarn is drawn or stretched (or shrunk) in the measurement zone. The tension measurement as a result of this drawing force may then be tracked.

Another test which may be accomplished with this system would be a weaving simulation in which the roll pairs are periodically oscillated in opposite directions to alternately stretch and relax the yarn. This could be accomplished as a static test in which there was not net movement of the yarn, or as a dynamic test in which there was net movement of the yarn while this oscillation was being accomplished.

Additionally, the system can be used to make a static draw force measurement, either at the end of a dynamic elongation test, or separately, by fixing the input roll pair and driving the output roll pair and concurrently measuring the tension in the measurement zone.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A system for moving yarn under substantially constant tension, comprising:

a translationally-fixed pivoting device, having a neutral position, for applying a tension to the yarn sufficient to stretch the yarn without breaking it, wherein said pivoting device is a cantilever having a yarn-contacting structure at a top of said cantilever's end, a neutral position that is vertical and a pivot point towards a bottom end of said cantilever;

a first variable-speed yarn drive upstream of the pivoting device for feeding yarn toward the pivoting device;

a second variable-speed yarn drive downstream of the pivoting device for moving the yarn across the pivoting device and through a measurement zone directly to said second yarn drive without contacting any mechanical structure between said pivoting device and said second yarn drive;

means for determining a pivotal position of the pivoting device in relation to its neutral position;

means, responsive to the means for determining a pivotal position of the pivoting device, for altering the speed of at least one of said first and second variable-speed yarn drive to move the pivoting device close to its neutral position for maintaining a relatively constant tension on the yarn, wherein said means for altering the speed includes a means for changing the speed of at least one of said first and second variable-speed yarn drive in relation to the magnitude of the pivotal deviation of the pivoting phrase of said first and second variable-speed yarn drive device from its neutral position.

2. The system of claim 1 in which said means for altering the speed of at least one said yarn drive includes means for changing the speed of the motor driving said first yarn drive mechanism.

3. The system of claim 1 in which said means for altering the speed of at least one said yarn drive includes means for changing the speed of the motor driving said second yarn drive mechanism.

4. The system of claim 1 in which said means for changing the speed of the yarn drive includes a proportional integral differential control system.

5. The system of claim 1 further including a spring coupled to the cantilever for applying tension to the yarn through the yarn-contacting structure.

6. The system of claim 5 further including means for adjusting the spring tension to alter the tension applied to the yarn.

7. The system of claim 1 in which the means for determining the rotational position of the pivoting device includes a rotary encoder device for sensing the rotational position of the pivoting device.

8. The system of claim 7 in which the means for determining pivotal position of the pivoting device includes a Hall-effect sensor for sensing the pivot position.

9. The system of claim 1 further including means for determining the speed of both yarn drive mechanisms.

10. The system of claim 9 further including means for determining a change in yarn length, caused by the applied tension, based on the speed of the two yarn drive mechanisms.

11. A system for moving yarn under substantially constant tension, comprising:

a translationally-fixed pivoting cantilever with a yarn-contacting structure at its end, the cantilever having a vertical neutral position;

a first yarn drive mechanism, driven by a first variable-speed motor, for moving yarn to the yarn-contacting structure;

a variable-tension spring coupled to the cantilever for applying a known tension to the yarn in the yarn-contacting structure when the cantilever is in its neutral position, the tension sufficient to stretch the yarn without breaking it;

a rotary encoder at the cantilever pivot that develops a control signal indicative of the cantilever pivotal position in relation to its neutral position;

a second yarn drive mechanism, driven by a second variable-speed motor, for pulling the yarn across the yarn-contacting structure and through a measurement zone directly to said second drive mechanism without contacting any mechanical structure between said yarn-contacting structure and said second drive mechanism; and a yarn speed control system, responsive to said rotary encoder control signal, for changing the speed of at least one said variable-speed motor in relation to the magnitude of the pivotal deviation of the cantilever from its neutral position, to move the cantilever closer to its neutral position for maintaining a relatively constant tension on the yarn; said speed control system controlling the speed of both yarn drive mechanisms with two separate drive signals both derived from said control signal to ensure synchronous operation of both yarn drive mechanisms.

12. A system for moving yarn under substantially constant tension, comprising:

first variable-speed yarn drive means for moving the yarn into a measurement zone having a known nominal yarn path length;

second, separate variable-speed yarn drive means for pulling the yarn out of the measurement zone;

means for determining a change in the yarn path length in the measurement zone between the first and second yarn drive means; and means, responsive to said means for determining a change in the yarn path length, for separately controlling the yarn drive speed of said first and second yarn drive means to change the yarn flow rate through the measurement zone for moving the yarn path length back closer to the known nominal path length.

13. The system of claim 12 in which said means for determining a change in the yarn path length includes means for creating a yarn reservoir portion between said first and second yarn drive means.

14. The system of claim 13 in which said means for determining a change in the yarn path length further includes means for resolving a change in yarn length in said reservoir portion.

15. The system of claim 13 in which said means for creating a yarn reservoir portion includes means for passing the yarn over a translationally-fixed compliant member.

16. The system of claim 15 in which said compliant member is a pivoting device.

* * * * *